US007967527B2

(12) United States Patent
Estes et al.

(10) Patent No.: US 7,967,527 B2
(45) **Date of Patent: *Jun. 28, 2011**

(54) CONCRETE SLAB JOINT SYSTEM INCLUDING A LOAD PLATE SLEEVE

(75) Inventors: Michael Estes, Brentwood, MO (US); James Vemmer, Union, MO (US)

(73) Assignee: Greenstreak Group, Inc., St. Louis, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/785,824

(22) Filed: May 24, 2010

(65) Prior Publication Data

US 2010/0229474 A1 Sep. 16, 2010

Related U.S. Application Data

(63) Continuation of application No. 11/830,983, filed on Jul. 31, 2007, now Pat. No. 7,748,928.

(51) Int. Cl.
*E01C 11/14* (2006.01)

(52) U.S. Cl. ..... 404/58; 404/61

(58) Field of Classification Search ..... 404/51–65
See application file for complete search history.

(56) References Cited

U.S. PATENT DOCUMENTS

| | | | |
|---|---|---|---|
| 5,005,331 | A | 4/1991 | Shaw et al. |
| 5,216,862 | A | 6/1993 | Shaw et al. |
| 5,713,174 | A | 2/1998 | Kramer |
| 5,797,231 | A | 8/1998 | Kramer |
| 6,145,262 | A | 11/2000 | Schrader et al. |
| 6,354,760 | B1 | 3/2002 | Boxall et al. |
| 7,201,535 | B2 | 4/2007 | Kramer |
| 7,303,357 | B2 | 12/2007 | Villarreal et al. |
| 2004/0187431 | A1 | 9/2004 | Boxall et al. |
| 2006/0275078 | A1 | 12/2006 | Shaw et al. |
| 2007/0231068 | A1 | 10/2007 | Francies et al. |

FOREIGN PATENT DOCUMENTS

| | | | |
|---|---|---|---|
| AU | 2006100394 | B4 | 5/2006 |
| GB | 2285641 | A1 | 7/1995 |

*Primary Examiner* — Raymond W Addie
(74) *Attorney, Agent, or Firm* — Armstrong Teasdale LLP

(57) ABSTRACT

A load plate sleeve assembly for maintaining a load plate in position between adjacent concrete slabs and facilitating controlled lateral movement of the load plate includes a housing and an insert clip coupled to the housing. The housing includes a top wall, a bottom wall, opposing side walls extending between the top and bottom walls, and an end wall extending between the top and bottom walls, and between the side walls. The walls define an internal cavity, and the housing includes a cavity access opening. The insert clip includes a opposing side walls having a first end and a second end. The insert clip also includes an end wall extending between the side walls, a plurality of deformable centering fingers extending from the side walls, and a collapsible diamond shaped center support extending from the end wall. The insert clip is positioned inside the internal cavity of the housing.

24 Claims, 4 Drawing Sheets

CONCRETE SLAB JOINT SYSTEM INCLUDING A LOAD PLATE SLEEVE

CROSS REFERENCE TO RELATED APPLICATIONS

This application is a Continuation of application Ser. No. 11/830,983, now U.S. Pat. No. 7,748,928, filed Jul. 31, 2007.

BACKGROUND OF THE INVENTION

This invention relates generally to concrete slab joint systems for transferring loads between adjacent concrete slabs, and more particularly a concrete slab joint system having a rectangular load plate and a load plate sleeve.

Large concrete floors and roads are typically formed from a plurality of cast in place concrete slabs that are separated by joints. Changes in atmospheric conditions and soil conditions can cause movement of the concrete slabs relative to one another. Typically, dowels are embedded into adjacent slabs to prevent movement perpendicular to the top surface of the slabs and to permit movement along the dowel direction, or movement of the slabs away from each other. However, the known round dowels do not permit lateral movement along the slab joints. The restraint of lateral movement of adjacent slabs can cause a build-up of stress in the slabs which can cause cracking in the concrete slabs.

BRIEF DESCRIPTION OF THE INVENTION

In one aspect, a load plate sleeve assembly for maintaining a load plate in position between adjacent concrete slabs and facilitating controlled lateral movement of the load plate is provided. The sleeve assembly includes a housing and an insert clip coupled to the housing. The housing includes a top wall, a bottom wall, a first side wall and a second opposing side wall extending between the top and bottom walls, and an end wall extending between the top and bottom wall, and between the first and second side walls. The top wall, bottom wall, opposing side walls, and end wall define an internal cavity. The housing further includes a cavity access opening located opposite the end wall. The insert clip includes a first side wall and an opposing second side wall, with each side wall having a first end and a second end. The insert clip also includes an end wall extending between the first ends of said first and second side walls, a plurality of deformable centering fingers extending from the first side wall, a plurality of deformable centering fingers extending from the second side wall, and a collapsible diamond shaped center support extending from the end wall. The insert clip is positioned inside the internal cavity so that the first and second side walls of the insert clip are adjacent to and in contact with an inner surface of the first and second side walls of the housing, and the end wall of the insert clip is adjacent to and in contact with the end wall of the end wall of the housing.

In another aspect, an insert clip insertable into a load plate sleeve housing is provided. The sleeve housing includes a top wall, a bottom wall, a first side wall and a second opposing side wall extending between the top and bottom walls, and an end wall extending between the top and bottom walls, and between the first and second side walls. The top wall, bottom wall, opposing side walls, and end wall define an internal cavity, and the housing also includes a cavity access opening and a flange extending from a periphery of the cavity access opening. The insert clip includes a first side wall and an opposing second side wall, with each side wall having a first end and a second end, an end wall extending between the first ends of the first and second side walls, a plurality of deformable centering fingers extending from the first side wall, a plurality of deformable centering fingers extending from the second side wall, and a collapsible diamond shaped center support extending from said end wall. The insert clip is sized to be received inside the internal cavity of the sleeve housing.

In another aspect, a concrete slab joint system is provided. The concrete slab joint system includes a first cast-in-place concrete slab, a second cast-in-place concrete slab, a joint separating the first and second concrete slabs, at least a portion of the joint being initially defined by an inner surface of an edge form, a plurality of rectangular load plates spaced apart along the longitudinal axis of the joint and protruding into both the first concrete slab and the second concrete slab, and a plurality of load plate sleeve assemblies protruding into the first concrete slab. Each load plate is inserted into a corresponding sleeve assembly. Each load plate sleeve assembly includes a housing and an insert clip coupled to the housing. The housing includes a top wall, a bottom wall, a first side wall and a second opposing side wall extending between the top and bottom walls, and an end wall extending between the top and bottom wall, and between the first and second side walls. The top wall, bottom wall, opposing side walls, and end wall define an internal cavity. The housing further includes a cavity access opening located opposite the end wall. The insert clip includes a first side wall and an opposing second side wall, with each side wall having a first end and a second end. The insert clip also includes an end wall extending between the first ends of said first and second side walls, a plurality of deformable centering fingers extending from the first side wall, a plurality of deformable centering fingers extending from the second side wall, and a collapsible diamond shaped center support extending from the end wall. The insert clip is positioned inside the internal cavity so that the first and second side walls of the insert clip are adjacent to and in contact with an inner surface of the first and second side walls of the housing, and the end wall of the insert clip is adjacent to and in contact with the end wall of the end wall of said housing.

DETAILED DESCRIPTION OF THE INVENTION

A load plate sleeve assembly that includes, in an exemplary embodiment, a sleeve housing and an insert clip coupled to the sleeve housing is described in detail below. The insert clip includes a plurality of centering fingers to center a load plate within the sleeve housing and to create an annular space between the load plate and the housing to permit lateral movement of the load plate. The load plate sleeve assembly together with the load plate provides a concrete slab joint system that transfers loads between a first concrete slab and a second, adjacent concrete slab that are separated by a joint. The load plate limits movement of the slabs perpendicular to the top surface of the slabs while permitting controlled lateral movement along the joint and movement away from each other.

Figure 1:
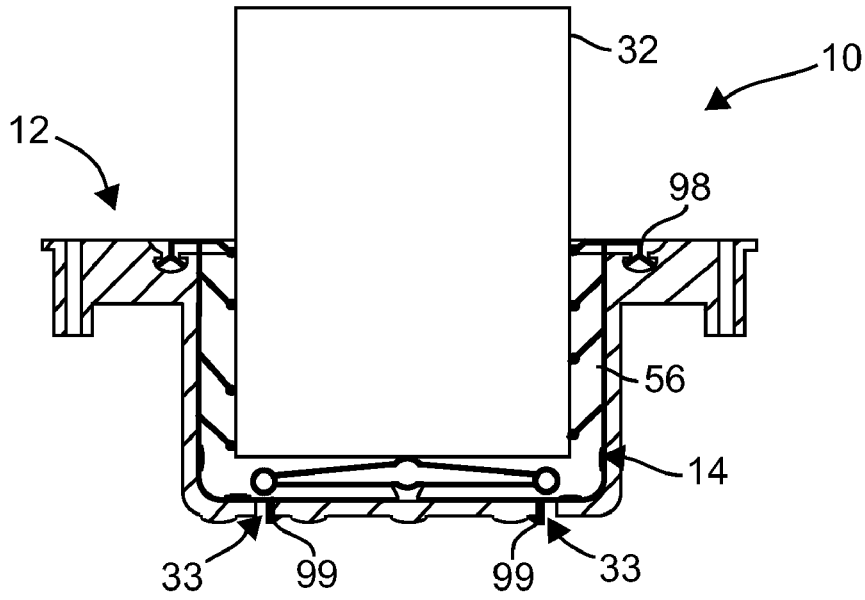
FIG. 1 is a sectional illustration of a load plate sleeve assembly in accordance with an embodiment of the present invention.
Figure 2:
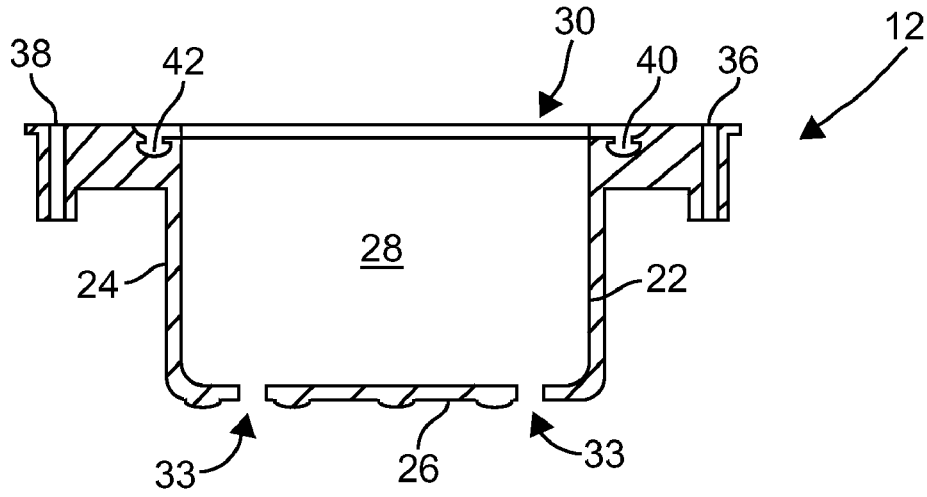
FIG. 2 is a sectional illustration of the sleeve housing shown in FIG. 1.
Figure 3:
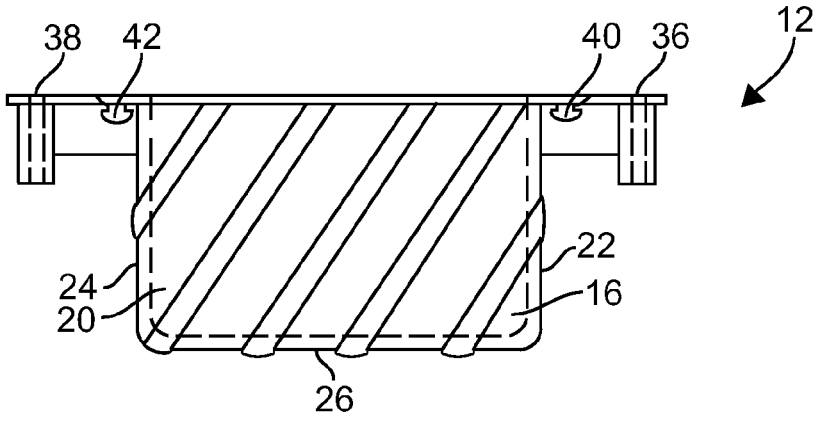
FIG. 3 is a top illustration of the sleeve housing shown in FIG. 1.
Figure 4:
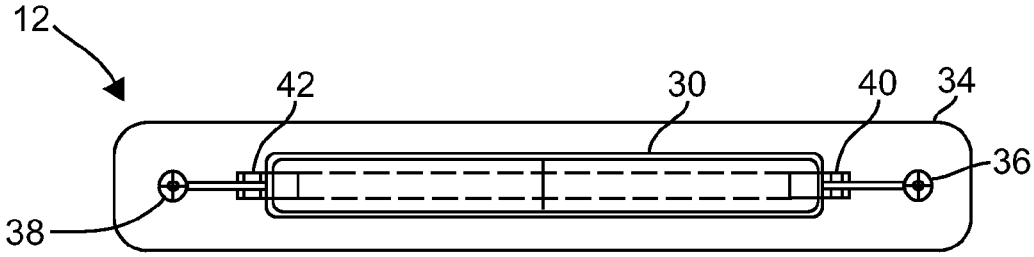
FIG. 4 is an end illustration of the sleeve housing shown in FIG. 1.
Figure 5:
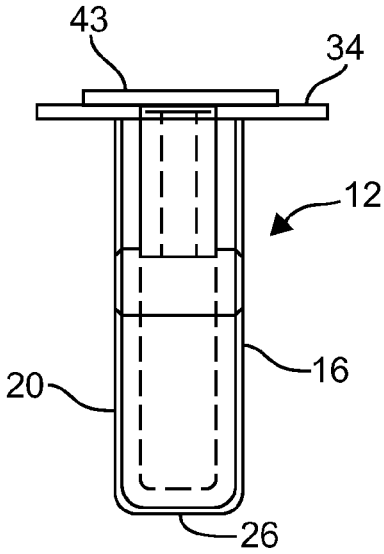
FIG. 5 is a side illustration of the sleeve housing shown in FIG. 1.

Referring to the drawings, FIG. 1 is sectional illustration of a load plate sleeve assembly 10 in accordance with an embodiment of the present invention. Sleeve assembly 10 includes a sleeve housing 12 and an insert clip 14 positioned inside sleeve housing 12. Sleeve housing 12 and insert clip are formed from thermoplastic materials. Suitable thermoplastic materials include, but are not limited to, polyethylene, and polypropylene, polystyrene, acrylonitrylstyrene, butadiene, polyesters, polyvinyl chloride, both plasticised and unplasticised, acrylics, polyarylene ethers, acrylonitrile-butylacrylate-styrene polymers, amorphous nylon, as well as alloys and blends of these materials with each other or other polymeric materials.

Referring also to FIGS. 2-5, sleeve housing 12 includes a top wall 16 and an opposing bottom wall 20. A first side wall 22 and an opposing second side wall 24 extend between top and bottom walls 16 and 20. An end wall 26 extends between top and bottom walls 16 and 20, and between first and second side walls 22 and 24. Top wall 16, bottom wall 20, side walls 22 and 24, and end wall 26 define an internal cavity 28 in housing 12. A cavity access opening 30 located opposite end wall 26 is sized to receive insert clip 14. Sleeve housing 12 is sized so that a portion of a load plate 32 can be inserted into cavity 28 through access opening 30. In the exemplary embodiment, sleeve housing 12 is sized to receive about half the length of load plate 32. End wall 26 includes a plurality of attachment openings 33 extending therethrough. In an alternate embodiment, end wall 26 does not include any openings.

Sleeve housing 12 also includes a flange 34 extending from the periphery of access opening 30 and orientated substantially perpendicular to top and bottom walls 16 and 20. Fastener openings 36 and 38 extend through flange 34 and permit sleeve assembly 10 to be mounted on a concrete slab edge form, for example a 2×6 inch board of wood. In the exemplary embodiment, sleeve housing 12 includes attachment cavities 40 and 42. Additionally, load plate sleeve assembly 10 can include a cover facing 43 (shown in FIG. 5) over cavity access opening to prevent concrete and other debris from entering sleeve housing 12 during a first concrete pour and prior to the placement of load plate 32 into sleeve housing 12. Cover facing can be any made from any suitable material, for example paper or plastic. Cover facing 43 is attached to flange 34 by any suitable method, for example, by the use of a suitable adhesive.

Figure 6:
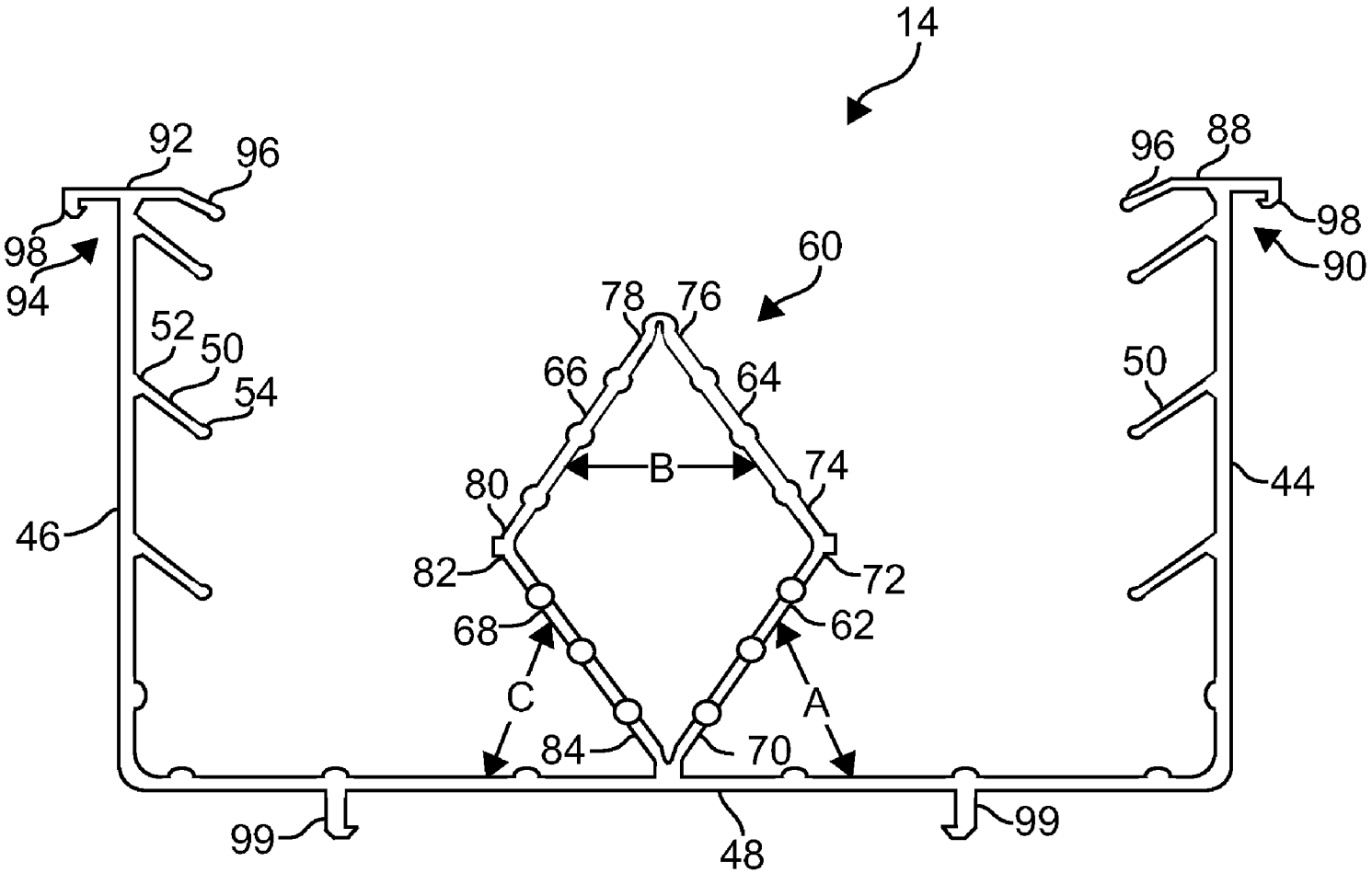
FIG. 6 is a top illustration of the insert clip shown in FIG. 1.

Referring to FIGS. 1 and 6, insert clip 14 includes a first side wall 44, a second opposing side wall 46, and an end wall 48 extending between side walls 44 and 46. A plurality of deformable centering fingers 50 extend from first side wall 44, and a plurality of deformable centering fingers 50 extend from second side wall 46. A first end 52 of centering fingers 50 are attached to side walls 44 and 46 and centering fingers 50 extend at an angle from side walls 44 and 46 towards end wall 48. A second end 54 of centering fingers 50 has a rounded shape to facilitate the insertion of load plate 32 into sleeve assembly 10. Centering fingers 50 can extend from side walls 44 and 46 at any downward angle, for example at about a 45 degree angle. Centering fingers 50 center steel load plate 32 in sleeve assembly 10 and create an annular space 56 between load plate 32 and side walls 44 and 46 to permit lateral movement of load plate 32.

A collapsible diamond shaped center support 60 extends from end wall 48. Center support 60 is formed from four support elements 62, 64, 66, and 68 pivotably connected. A first end 70 of support element 62 is pivotably attached to end wall 48 and a second end 72 is pivotably attached to a first end 74 of support element 64. A second end 76 of support element 64 is pivotably attached to a first end 78 of support element 66, and a second end 80 of support element 66 is pivotably attached to a first end 82 of support element 68. A second end 84 of support element 68 is pivotably attached to end wall 48. In the exemplary embodiment, when center support 60 is in a non-collapsed position, an angle A between support 62 and end wall 48 is about 60 degrees, an angle B between support element 64 and 66 is about 60 degrees, and an angle C between support element 68 and end wall 48 is about 60 degrees. In alternate embodiments, angles A, B, and C can be other than 60 degrees. Collapsible center support 60 maintains the structure of housing 12 by preventing concrete pressure from pushing in top wall 16 and bottom wall 20 of housing 12 during the pouring of the concrete of the concrete slab.

A first attachment member 88 extends substantially perpendicularly from an end 90 of first side wall 44, and a second attachment member 92 substantially perpendicularly from an end 94 of second side wall 46. A top centering finger 96 extends from one end of each of attachment members 88 and 92. Top centering fingers 96 create a seal between load plate 32 and insert clip 14 to prevent wet concrete from intruding into annular space 56 during the concrete pour for the second concrete slab. Concrete in annular space 56 can bind load plate 32 and prevent lateral movement of load plate 32. An attachment nub 98 extends from the other end of each attachment members 88 and 92. In one embodiment, attachment nubs 98 have a J-shape (shown in FIG. 6), and in another embodiment, attachment nubs 98 are split (shown in FIG. 1) to provide for a secure press-fit in attachment cavities 40 and 42 to securely attach insert clip 14 to sleeve housing 12. In alternate embodiments, other means for attaching insert clip 14 to sleeve housing 12, for example, a fastener, an adhesive, and ultrasonic or heat welding.

Additionally, a plurality of attachment nubs 99 extend from end wall 48. Attachment nubs 99 are positioned and sized to extend through attachment openings 33 of end wall 26 of sleeve housing 12. In one embodiment, attachment nubs 98 have a J-shape (shown in FIG. 6), and in another embodiment, attachment nubs 98 are split to provide for a secure press-fit in attachment openings 33. In an alternate embodiment, end wall 48 of insert clip 14 does not include any attachment nubs.

Figure 7:
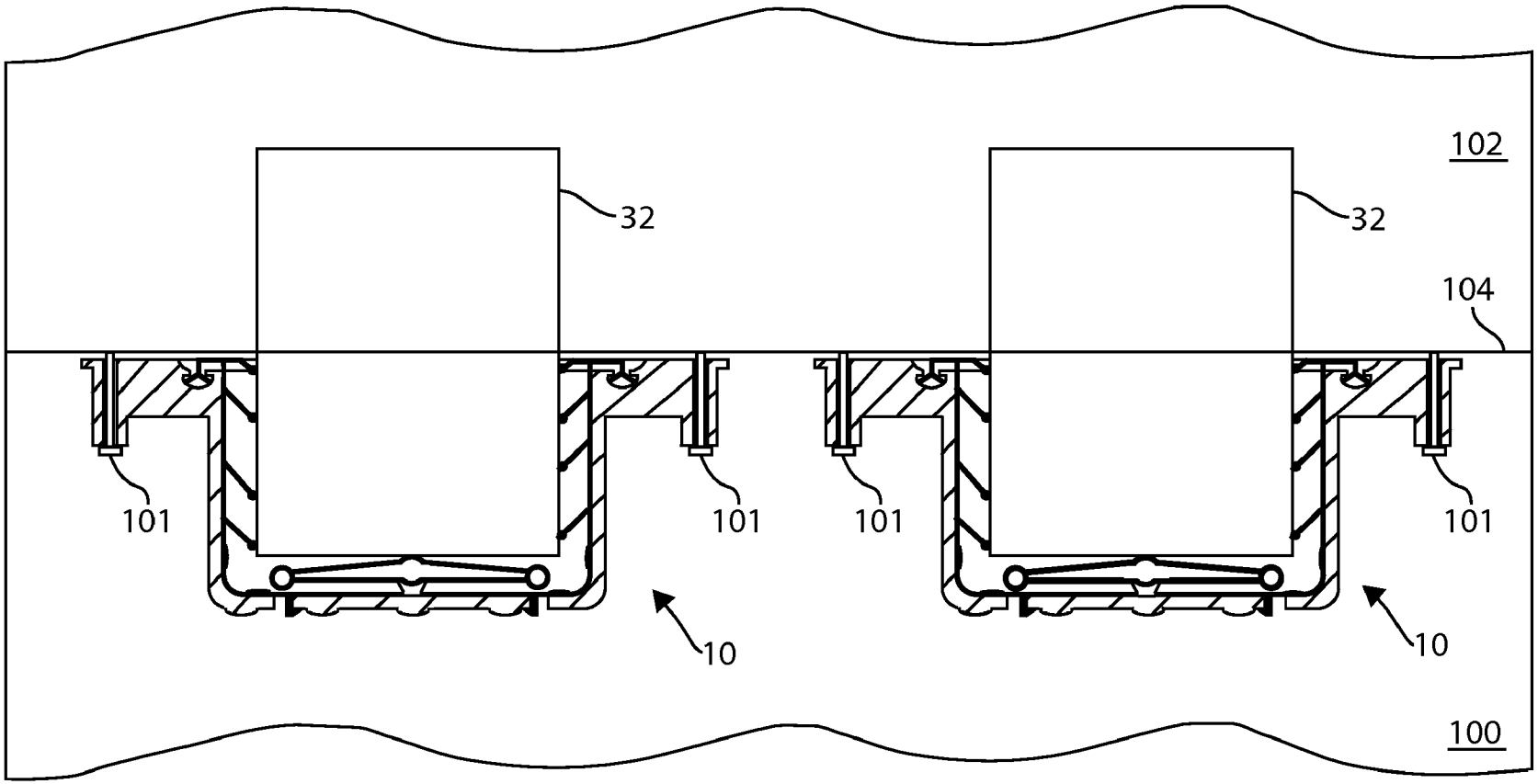
FIG. 7 is a top illustration of the load plate sleeve assembly embedded in two adjacent concrete slabs.

Referring also to FIG. 7, in use, load plate sleeve assembly 10 is attached to an edge form for a concrete slab so that sleeve assembly 10 is embedded in a first concrete slab 100 after the concrete is poured. After the first concrete slab has hardened the edge form is removed leaving load plate sleeve assembly 10 embedded in first concrete slab 100. One end of load plate 32 is then inserted into sleeve assembly 10 which collapses diamond shaped center support 60. Load plate 32 is held in place inside load plate sleeve assembly 10 by centering fingers 90 and top centering fingers 96. A second concrete slab 102 is then poured and allowed to harden such that the other end of load plate 32 is embedded in the second concrete slab 102. A joint 104 separates first concrete slab 100 and second concrete slab 102.

While the invention has been described in terms of various specific embodiments, those skilled in the art will recognize that the invention can be practiced with modification within the spirit and scope of the claims.

What is claimed is:

1. A load plate sleeve assembly comprising:

a housing comprising an internal cavity; and an insert clip located in said housing cavity and coupled to said housing;

said housing comprising a top wall, a bottom wall, a first side wall and a second opposing side wall extending between said top and bottom walls, and an end wall extending between said top and bottom wall, and between said first and second side walls, said top wall, said bottom wall, said opposing side walls, and said end wall defining said internal cavity, said housing further comprising a cavity access opening located opposite said end wall;

said insert clip comprising:

a first side wall and an opposing second side wall, each said side wall having a first end and a second end;

an end wall extending between said first ends of said first and second side walls; and a collapsible center support extending from said end wall, said collapsible center support comprising at least two members, wherein two of said at least two members are attached to said end wall and attached to each other;

said end wall of said housing comprising a plurality of attachment openings extending therethrough, and said end wall of said insert clip comprising a plurality of attachment nubs, said attachment nubs sized and positioned to extend through said attachment openings of said end wall of said housing.

2. A load plate sleeve assembly in accordance with claim 1 further comprising a plurality of deformable centering fingers extending from said first side wall, and a plurality of deformable centering fingers extending from said second side wall.

3. A load plate sleeve assembly in accordance with claim 2 wherein said centering fingers extend at an angle from said first and second side walls of said insert clip toward said end wall of said insert clip.

4. A load plate sleeve assembly in accordance with claim 1 wherein said housing further comprises a flange extending from a periphery of said cavity access opening.

5. A load plate sleeve assembly in accordance with claim 4 wherein said insert clip further comprises a first attachment member extending from said second end of said first side wall of said insert clip, and a second attachment member extending from said second end of said second side wall of said insert clip, each said attachment member comprising a means for attaching said insert clip to said housing flange.

6. A load plate sleeve assembly in accordance with claim 5 wherein said housing comprises a first and a second attachment cavity and said means for attaching said insert clip to said housing comprises an attachment nub extending from a first end of each said first and said second attachment members, each said attachment nub positioned in one of said attachment cavities in a press-fit relationship.

7. A load plate sleeve assembly in accordance with claim 4 wherein said flange comprises a plurality of fastener openings sized to receive a fastener for attaching said load plate sleeve to a concrete slab edge form.

8. A load plate sleeve assembly in accordance with claim 4 further comprising a cover facing attached to said flange and covering said cavity access opening.

9. A load plate sleeve assembly in accordance with claim 1 wherein said collapsible center support has a substantially diamond shaped.

10. An insert clip insertable into a load plate sleeve housing, the sleeve housing comprising a top wall, a bottom wall, a first side wall and a second opposing side wall extending between the top and bottom walls, and an end wall extending between the top and bottom walls, and between the first and second side walls, the top wall, bottom wall, opposing side walls, and end wall defining an internal cavity, the end wall of said end wall comprising a plurality of attachment openings extending therethrough, the housing further comprising a cavity access opening and a flange extending from a periphery of the cavity access opening, said insert clip comprising:

a first side wall and an opposing second side wall, each said side wall having a first end and a second end;

an end wall extending between said first ends of said first and second side walls; and a collapsible center support extending from said end wall, said collapsible center support comprising at least two members wherein two of said at least two members are attached to said end wall and attached to each other;

said end wall of said insert clip comprising a plurality of attachment nubs, said attachment nubs sized and positioned to extend through the attachment openings of the end wall of the housing.

11. An insert clip in accordance with claim 10 further comprising a plurality of deformable centering fingers extending from said first side wall, and a plurality of deformable centering fingers extending from said second side wall.

12. A load plate sleeve assembly in accordance with claim 11 wherein said centering fingers extend at an angle from said first and second side walls of said insert clip toward said end wall of said insert clip.

13. An insert clip in accordance with claim 10 wherein said insert clip further comprising a first attachment member extending from said second end of said first side wall of said insert clip, and a second attachment member extending from said second end of said second side wall of said insert clip, each said attachment member comprising a means for attaching said insert clip to the housing flange.

14. An insert clip in accordance with claim 13 wherein said means for attaching said insert clip to the housing flange comprises an attachment nub extending from a first end of each said first and said second attachment members.

15. An insert clip in accordance with claim 13 wherein said means for attaching said insert clip to the housing flange comprises at least one of an adhesive and a sonic welding seam.

16. A concrete slab joint system comprising:

a first cast-in-place concrete slab;

a second cast-in-place concrete slab;

a joint separating the first and second concrete slabs, at least a portion of the joint being initially defined by an inner surface of an edge form;

a plurality of rectangular load plates spaced apart along the longitudinal axis of said joint and protruding into both said first concrete slab and said second concrete slab; and a plurality of load plate sleeve assemblies protruding into said first concrete slab, each said load plate inserted into a corresponding sleeve assembly, each said load plate sleeve assembly comprising:

a housing comprising an internal cavity; and an insert clip located in said housing cavity and coupled to said housing;

said housing comprising a top wall, a bottom wall, a first side wall and a second opposing side wall extending between said top and bottom walls, and an end wall extending between said top and bottom wall, and between said first and second side walls, said top wall, said bottom wall, said opposing side walls, and said end wall defining said internal cavity, said housing further comprising a cavity access opening located opposite said end wall;

said insert clip comprising:

a first side wall and an opposing second side wall, each said side wall having a first end and a second end;

an end wall extending between said first ends of said first and second side walls; and a collapsible center support extending from said end wall, said collapsible center support comprising at least two members wherein two of said at least two members are attached to said end wall and attached to each other;

said end wall of said housing comprising a plurality of attachment openings extending therethrough, and said end wall of said insert clip comprising a plurality of attachment nubs, said attachment nubs sized and positioned to extend through said attachment openings of said end wall of said housing.

17. A concrete slab joint system in accordance with claim 16 further comprising a plurality of deformable centering fingers extending from said first side wall, and a plurality of deformable centering fingers extending from said second side wall.

18. A concrete slab joint system in accordance with claim 17 wherein said centering fingers extend at an angle from said first and second side walls of said insert clip toward said end wall of said insert clip.

19. A concrete slab joint system in accordance with claim 16 wherein said housing further comprises a flange extending from a periphery of said cavity access opening.

20. A concrete slab joint system in accordance with claim 19 wherein said insert clip further comprising a first attachment member extending from said second end of said first side wall of said insert clip, and a second attachment member extending from said second end of said second side wall of said insert clip, each said attachment member comprising a means for attaching said insert clip to said housing flange.

21. A concrete slab joint system in accordance with claim 20 wherein said housing comprises a first and a second attachment cavity and said means for attaching said insert clip to said housing comprises an attachment nub extending from a first end of each said first and said second attachment members, each said attachment nub positioned in one of said attachment cavities in a press-fit relationship.

22. A concrete slab joint system in accordance with claim 19 wherein said flange comprises a plurality of fastener openings sized to receive a fastener for attaching said load plate sleeve to a concrete slab edge form.

23. A concrete slab joint system in accordance with claim 19 further comprising a cover facing attached to said flange and covering said cavity access opening.

24. A concrete slab joint system in accordance with claim 16 wherein said collapsible center support having a substantially diamond shaped.

* * * * *